US005385322A

United States Patent [19]

Kim et al.

[11] Patent Number: 5,385,322

[45] Date of Patent: Jan. 31, 1995

[54] ERGONOMIC ELBOW REST

[75] Inventors: Kwan Kim, Garden Grove; Victor S. Packham, Costa Mesa, both of Calif.

[73] Assignee: Baxter International Inc., Deerfield, Ill.

[21] Appl. No.: 130,216

[22] Filed: Oct. 1, 1993

[51] Int. Cl.[6] ..... B63G 5/00

[52] U.S. Cl. ..... 248/118; 248/118.3

[58] Field of Search ..... 248/118, 118.3, 118.1, 248/118.5, 918, 231.7; 400/715; 297/411.24, 411.35

[56] References Cited

U.S. PATENT DOCUMENTS

| | | | |
|---|---|---|---|
| D. 264,164 | 5/1982 | Salibello et al. . | |
| D. 284,436 | 7/1986 | Hodges . | |
| 1,266,367 | 5/1918 | Wilson . | |
| 3,300,250 | 1/1967 | Dollgener | 248/118.1 |
| 3,929,309 | 12/1975 | DeVore . | |
| 4,390,011 | 6/1983 | Evans . | |
| 4,545,554 | 10/1985 | Latino | 248/118.3 X |
| 4,564,164 | 1/1986 | Allen | 248/118.5 X |
| 4,688,862 | 8/1987 | Fowler | 248/118.3 X |
| 4,822,103 | 4/1989 | Stenvall . | |
| 4,913,393 | 4/1990 | Wood . | |
| 4,976,407 | 12/1990 | Schwartz | 400/715 X |
| 4,997,054 | 3/1991 | Denny et al. . | |
| 5,022,622 | 6/1991 | Schaevitz . | |
| 5,048,784 | 9/1991 | Schwartz | 400/715 X |
| 5,072,905 | 12/1991 | Hyatt | 248/918 X |
| 5,074,501 | 12/1991 | Holtta . | |
| 5,103,516 | 4/1992 | Stevens . | |
| 5,104,073 | 4/1992 | Van Beek | 248/118.3 |
| 5,108,057 | 4/1992 | Dandy, III et al. . | |
| 5,135,190 | 8/1992 | Wilson . | |
| 5,158,256 | 10/1992 | Gross . | |
| 5,161,760 | 11/1992 | Terbrack . | |
| 5,234,186 | 8/1993 | Powell | 400/715 X |
| 5,288,042 | 2/1994 | Grimm | 248/118 |

FOREIGN PATENT DOCUMENTS

| | | | |
|---|---|---|---|
| 5556 | 11/1979 | European Pat. Off. . | |
| 0050204 | 4/1982 | European Pat. Off. | 248/118 |
| 317835 | 5/1989 | European Pat. Off. . | |
| 835452 | 1/1958 | United Kingdom . | |
| 1395806 | 8/1973 | United Kingdom . | |
| WO8904623 | 6/1989 | WIPO . | |
| WO8909558 | 10/1989 | WIPO . | |
| WO9106233 | 5/1991 | WIPO . | |
| WO9114384 | 10/1991 | WIPO . | |

*Primary Examiner*—J. Franklin Foss

*Attorney, Agent, or Firm*—Poms Smith Lande & Rose

[57] ABSTRACT

An ergonomic elbow rest includes a conformal elbow support pad with arms cushioned to receive and support a user's elbow, including possibly a significant portion of the upper body weight of the user, with full adjustability of position of the elbow support pad relative to a work bench or table at which the user is to perform a task. The elbow rest assists in steadying the user's hands, and also assists in maintaining a fatigue-resistant erect spinal and head posture for the user. The elbow support pad may include a recess or a through hole for receiving and maintaining a preferred position of the user's elbow during performance of the work task.

20 Claims, 3 Drawing Sheets

ERGONOMIC ELBOW REST

BACKGROUND OF THE INVENTION

1. Field of the Invention

The present invention is in the field of elbow rests. More particularly, the present invention relates to an elbow rest which secures adjacent to the forward top edge of a table or work bench, for example. The elbow rest includes an elbow pad configured ergonomically to advantageously comfort and assist a user of the elbow rest to perform a task at the work bench; as well as a universally adjustable support structure securing at a forward top edge to the work bench and which provides six degrees of supportive positioning of the elbow pad relative to the forward edge and upper surface of the work bench. An upper surface of the elbow pad is resilient to cushion and support the user's elbow; and may optionally include a recess or through hole to assist the user in positioning and retaining the elbow in a secure and comfortable position on the elbow rest.

2. Related Technology

A conventional forearm support is known in accord with PCT application PCT/SE91/00202, having a publication number of WO 91/14384, and a publication date of Oct. 3 1991, in which the forearm support includes a bracket securing to the forward edge of a table or work bench, for example, by means of a clamp screw. The bracket carries a vertically extending stem upon which is pivotally secured a housing. The housing defines a horizontal bore in which a first end of a first pivotally adjustable generally horizontally extending cantilevered arm is secured. The first arm includes a second end which is offset relative to the first end so that pivotal movement of the first arm about the horizontal axis of the bore results in vertical movement of the second arm end. At the second end, the first arm carries a similar second housing with a vertically extending bore in which is received a first end of a second generally horizontally extending cantilevered arm. This second arm is pivotal in a horizontal plane by pivotal movement in the second housing. At a second end, the second arm carries a forearm support element, generally in the shape of an elongate trough, which is pivotal about a vertical axis to adjust the direction of the forearm support element to the user's preferences. All of the pivotal joints of the forearm rest include individual securing screws which allow the user to adjust and then retain a preferred position for the forearm supporting element.

With a forearm support as taught by the above-referenced application, the support in the vertical direction provided to a user's forearm is apt to be somewhat resilient because of the elongate and horizontally extending cantilevered arms which support the support element itself from the work bench. That is, each of these cantilevered arms acts like a leaf spring or end loaded simple cantilevered beam supported only at one end opposite the applied load. The result is a support structure which is not very strong, and which is springy or yielding in response to applied weight from a user of the support structure.

Another ergonomic support system is seen in U.S. Pat. No. 5,135,190, issued Aug. 4, 1992, in which an elongate forearm support feeder trough leads to a cylindrical palm and wrist support member. An oblate palm and wrist support member may alternatively be used with the feeder trough. A support structure for the forearm support with respect to a table or work bench, for example, may include a plurality of adjustably intersecuring generally horizontally-extending cantilevered arm members. A clamp bracket secures to the table or work bench by use of a clamp screw with a small screw jack type of stand off mechanism to keep the jaws of the clamp parallel and prevent their slipping.

The support shown in the '198 patent also may suffer from the deficiency of too much resilience in the horizontal support provided to a user of the support. In other words, the user will rely on such a support to steady the hands as well as to provide support to a portion of the user's upper body weight in order to avoid fatigue and improve posture in doing tasks at a work bench, for example. If the support is too resilient in the vertical direction under the weight of the user's upper body, not only will the user not be as comfortable with resting the upper body weight on the support, but the steadying of the user's hands by the support will be compromised as the support yields under the user's weight, and shifts with variations in the amount of weight which the user places on the support.

Yet another support apparatus is known in accord with U.S. Pat. No. 5,128,256, issued Oct. 27, 1992. The '256 patent teaches a keyboard accessory including a tray-like member which goes under a computer keyboard, and includes a forward depending rail slidably supporting a pair of wrist and hand supports for a user of the computer keyboard. The wrist and hand support pads of the '256 patent are adjustable for horizontal position and height. However, the support of this patent is not contemplated to sustain more than the forearm, wrist and hand weight of a user. In other words, it appears that the support taught by the '256 patent would not assist the user in maintaining a more comfortable and less stressful posture by sustaining a significant portion of the user's upper body weight, nor would it be suitable for steadying the user's hands by supporting the user's elbows.

SUMMARY OF THE INVENTION

In view of the deficiencies of the known support apparatus, it is an object for the present invention to provide an ergonomic elbow support which will avoid strain for workers performing tasks at a table or work bench, for example.

Another object for this invention is to provide such an ergonomic elbow support which is effective to relieve pain or discomfort experienced by such workers resulting from faulty posture, by encouraging the worker to effect a more correct working posture.

Still another object for the present invention is to provide such an ergonomic elbow support which is readily adaptable to workers with a variety of body sizes, and anatomies.

Another object for the present invention is to provide such an ergonomic elbow support which is universally adjustable to provide a selective position of support for the worker's elbows both in height and depth relative to the work table, and preferably includes six degrees of adjustability or freedom with respect to the support provided to the worker's elbows.

Still another object for the present invention is to provide such an ergonomic elbow support having a uniquely contoured elbow support element of especially great utility in supporting the workers upper body, elbows, and steadying the worker's hands as well.

Yet another object for this invention is to provide an ergonomic elbow support which includes an elbow support element having a recess or through hole to assist the user in positioning and maintaining the user's elbow in an advantageously positioned and supported relation to the user's body for performing the tasks at hand for the worker.

Accordingly, the present invention provides: an ergonomic elbow support having a clamp member supportingly engageable with a table top adjacent a forward edge thereof, the clamp member carrying a generally horizontally extending elongate first support member extending forwardly generally perpendicularly to the table top forward edge, the first support member carrying a clamp structure of two parts, a first of said two parts of said clamp structure selectively adjustably engaging said first support member both for pivotal movement about the axis thereof and for sliding longitudinal movement along the length of said first support member toward and away from said forward table top edge, a second of said two parts of said clamp member being pivotally carried by said first clamp member part for pivotal movement about an axis perpendicular to said first support member; and said second clamp member part carrying an elongate second support member which may extend generally vertically, said second support member being selectively adjustably engaged by said second clamp member part both for relative pivotal movement and for relative longitudinal movement along the axis of said second elongate support member (vertically relative to the table top surface), said clamp member including selectively adjustable securing means for simultaneously locking all of said pivotal and longitudinal relative movements of said clamp member parts relative to one another and relative to said first and second support members, said elongate second support member at an upper end thereof carrying a generally planar cushioned ergonomic elbow support member.

Additionally, an elbow support as described above may include an ergonomic elbow support member which in plan view includes an arcuate edge surface in supporting juxtaposition with a user's upper body.

Still additionally, the ergonomic elbow support member may include a recess or through hole which assists the user in preferably positioning and in maintaining the preferred position for the user's elbow.

Importantly, the present ergonomic elbow support apparatus includes only a single horizontally extending (cantilevered) support element so that the support is comparatively solid and not yielding when the user of the support rests body weight on the elbows.

Another important advantage of the present invention is the great assistance it offers to users in maintaining a proper and fatigue-resistant posture of work. That is, the user may rest a significant portion of body weight on the elbows, have a steady support for the elbows which steadies the hands, and have a more erect posture with the head more upright and a reduced weight on the spine.

These and additional objects and advantages of the present invention will be apparent from a reading of the following description of a particularly preferred exemplary embodiment of the present invention taken in conjunction with the following drawing Figures, in which:

DESCRIPTION OF THE DRAWING FIGURES

FIG. 1 provides a fragmentary perspective view of a worker seated at a work table and using an ergonomic elbow rest according to the present invention;

DETAILED DESCRIPTION OF THE PREFERRED EXEMPLARY EMBODIMENT OF THE INVENTION

Figure 1:
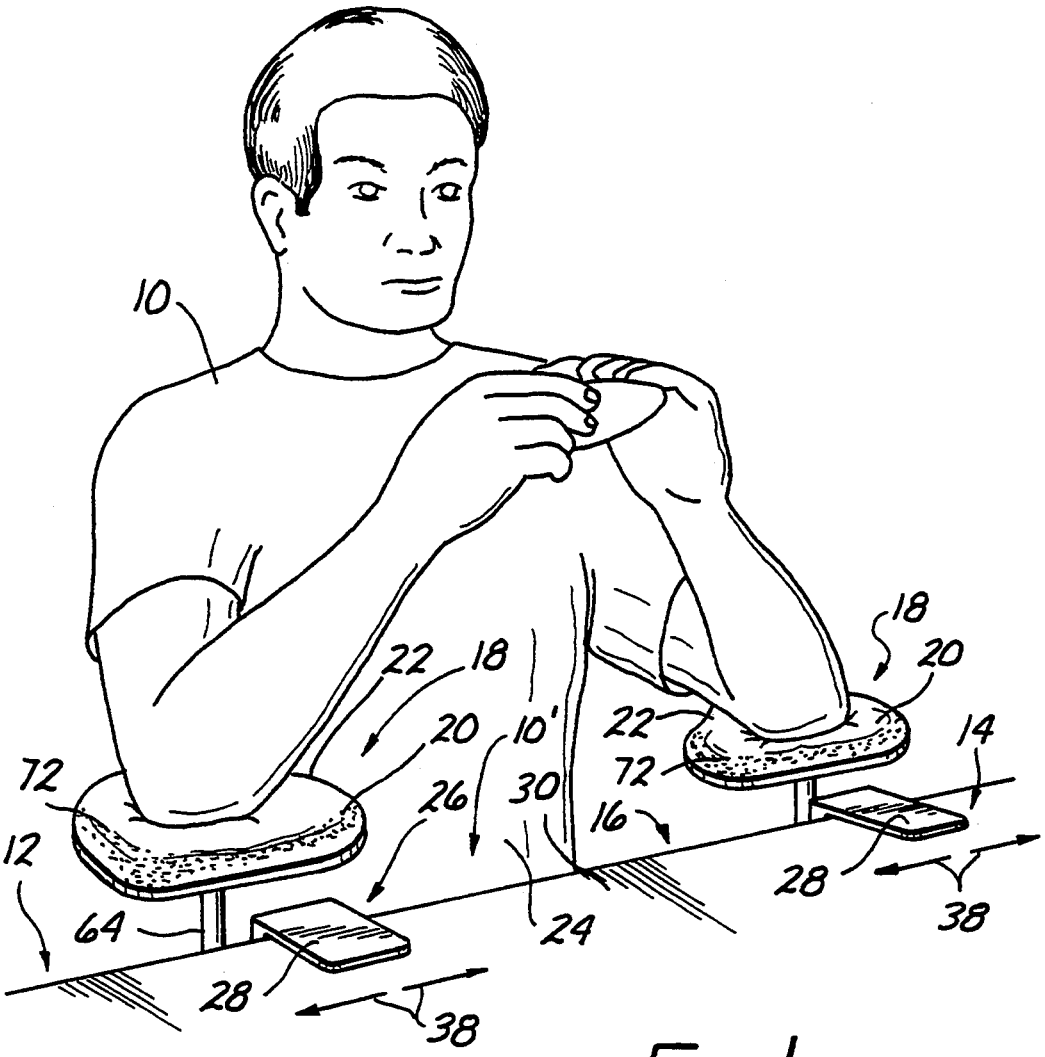
Figure 2:
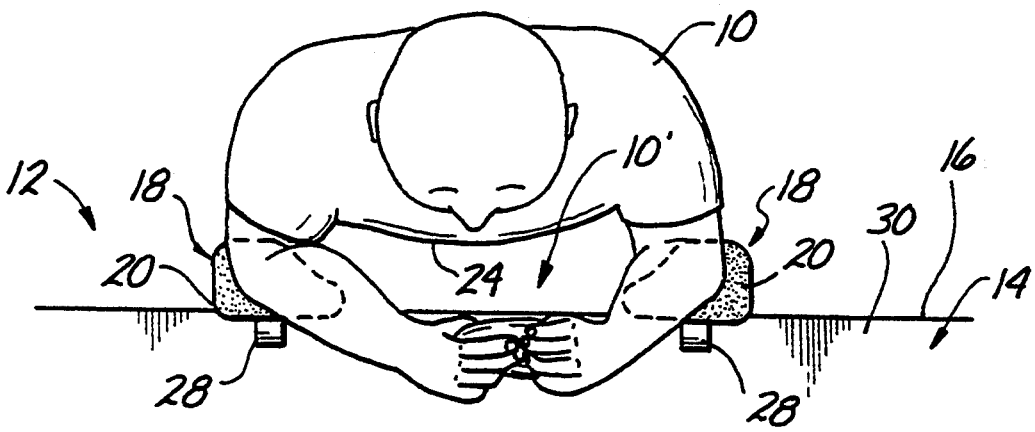
FIG. 2 is a fragmentary top plan view of the worker seen in FIG. 1, along with the table top and elbow rests being used by the worker.

Viewing the drawing Figures in conjunction with one another, and viewing particularly FIGS. 1 and 2, a human user 10 is seen seated at a table 12. The user is seated upon a chair or stool (not shown) which is out of sight below the level of the top 14 of table 12. While the present invention may be applied to equal advantages in a number of work environments, a particularly advantageous work environment in which the present invention may find application is to those manufacturing environments involving fine hand work. Table top 14 includes a forward edge 16, and slightly forward of the edge 16 a pair of ergonomic elbow rests 18 are secured to the table top 14. These ergonomic elbow rests 18 each include a cushioned elbow pad 20 upon which the user 10 is resting his elbows in order to be comfortably assisted to perform a work task at the table 12.

Because to the ergonomic elbow rests 18, the worker 10 is assisted in maintaining an erect posture with the spine straight rather than slouched, and the head erect rather than bowed forward over the table top 14. This posture for the worker 10 is much less fatiguing, and the worker 10 also beneficially has his hands steadied because of the support provided to his arms at the elbows by elbow pads 20. FIG. 2 shows that the elbow pads 20 are configured to include an arcuate side edge 22 extending circumferentially to the worker's torso in a conformal fashion. Consequently, the elbow pads 22 may optionally be positioned by the worker 10, if desired, in a closely spaced and supporting relation to the upper body of the worker 10. In this position, the elbow pads 20 may receive a substantial portion of the worker's weight, and thus steady the worker so that the task to be performed is more easily accomplished, while at the same time promoting an erect posture which is less tiring for the worker 10.

Figure 3:
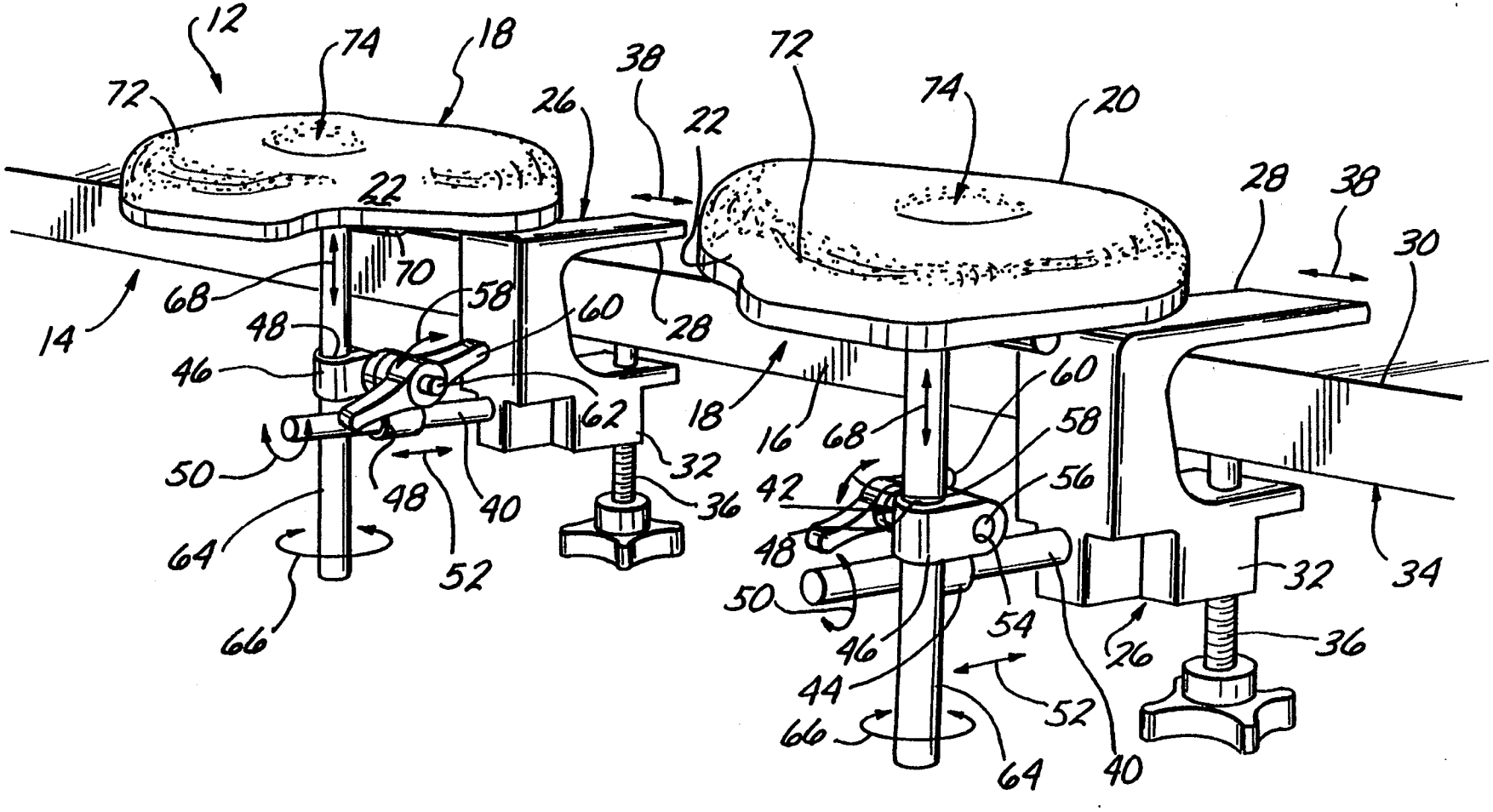
FIG. 3 is a fragmentary perspective view from an elevation just above the plane of the table top seen in FIGS. 1 and 2, and showing the details of the ergonomic elbow rests and their associated support structure engaging the table top.

Viewing particularly FIG. 3, is seen that the elbow rests 18 are made in "rights" and "lefts", so as to accommodate the respective elbows of the user 10. Because of the fact that, with the exception of the elbow pads 20 themselves, the elbow rests 18 are substantially the same, the features of the pair of elbow rests are described in conjunction with one another taking advantage of the visibility of the various features of the structure provided by FIG. 3, and without distinguishing whether reference is made to the left-hand or right-hand one of the pair of elbow rests 18. That is, the identical same reference numerals are being applied to each of the two elbow rests to indicate the analogous parts of both of the elbow rests. Moreover, only the elbow pads 20 themselves are made in "rights" and "lefts" and the remainder of the structure of each one of the elbow rests 18 is substantially identical, with the exception of the orientation of some of the parts at assembly of the support structure to adapt this support structure for better access and adjustment with either the user's right or left hand, as will appear from the following description.

Viewing FIG. 3, each elbow rest includes a C-shaped clamp member 26 which straddles the forward edge 16 of the table top 14. This clamp member 26 includes an upper flange portion 28 which rests upon the upper surface 30 of the table top 14. Similarly, a lower flange portion 32 extends below the lower surface 34 of the table top 14, and carries a clamp screw 36 which forcefully engages the surface 34. Because the clamp members 26 may engage the table top 14 at a variety of locations selectively along the front edge, the elbow rests have a first degree of freedom or adjustment indicated by the double headed arrows 38.

The clamp member 26 carries a horizontally extending cylindrical support member or rod 40 which extends forwardly of the forward edge 16 of the table top 14. This rod 40 extends forwardly of the forward edge 16 generally perpendicularly to the latter and is spaced slightly below and generally parallel with the top surface 30. Carried on the rod 40 is a clamp structure 42 of two pivotally connected primary parts 44 and 46. Each of the parts 44 and 46 are substantially the same, with the part 44 engaging the rod 40. Each of the parts 44, 46 is generally stirrup-shaped to define a bore 48. In the case of part 44, the bore 48 pivotally and slidably receives the rod 40. That is, the part 44 is pivotal on the rod 40, as is indicated by arcuate arrow 50. The part 44 is also slidable along the rod 40 as is indicated by arrow 52. Carried by the part 44 at a bore which is transverse to and spaced from the bore 48, as is generally indicated with arrow 54, is a clamp bolt 56, only an end portion of each clamp bolt being visible in FIG. 3. This clamp bolt 56 pivotally carries the second part 46 of the clamp structure 42, as is indicated by arcuate arrow 58. A locking handle 60 is threadably received on a threaded end portion 62 of the clamp bolt 56, and is effective as will be seen to immobilize the clamp structure 42 and associated parts with the tightening of the single clamp bolt 56 by use of the handle 60.

Pivotally and slidably received in the corresponding bore 48 of the second clamp part 46 is a generally vertically extending support member or shaft 64. This shaft 64 is pivotal and slidable in the second clamp part 46, as is indicated by respective arcuate and linear arrows 66 and 68. At its upper end, the shaft 64 includes a mounting flange 70, only a small portion of which is visible in FIG. 3. The cushioned elbow pad 20 is secured to the flange 70 with screws or other such fasteners engaging the flange 70 and an internal stiffener member or base board (not shown) of the pad 20. Preferably, the pad 20 is formed using an injection molding process forming foam polymer material over the base board of the elbow pad 20 in a process which causes the foam material to self-skin. In other words, no upholstery material is necessary over the polymer material, which cushions the pad 20, and this self-skinned polymeric material inherently provides a wear resistant surface which also insures good traction for the user's elbows.

Viewing particularly FIGS. 1 and 3, it is seen that the elbow pad 20 includes an upper cushion surface 72 forming a recess 74. This recess 74 is effective to assist the user 10 in initially placing the elbows in an advantageous position for performing work tasks at the table 12, and then in retaining the elbows in this advantageous work position. Particularly, it is seen that the elbow pads 20 include an arcuate side edge surface 22 which confronts and may be engaged by the torso of the user 10 while the user rests the elbows on the pads 20. As is best seen in FIG. 2, the user may lean into the arcuate work space 10' created by a spaced apart pair of the elbow rests 18, and there be assisted in maintaining an advantageous work position and posture for performing work tasks at the table 12.

Figure 4:
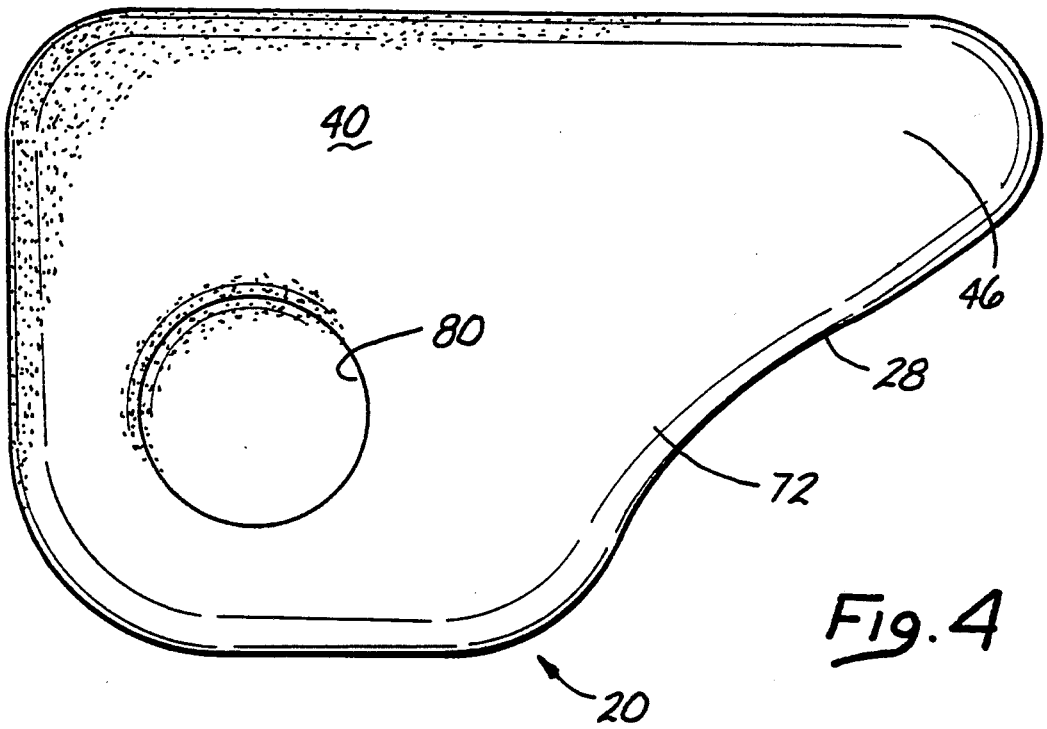
FIG. 4 shows an enlarged plan view of one elbow pad (the left-hand one) of the ergonomic elbow rests seen in the other drawing Figures.

Viewing FIG. 4, it is seen that in plan view the elbow pads 20 have somewhat the shape of a grand piano (the piano keyboard would be at the left end of FIG. 4), with the arcuate side edge surface 22 of this ergonomic support pad shape being disposed toward the user 10. FIG. 4 shows only one (the left-hand one) of the elbow pads 20. The right-hand elbow pad is a mirror image of the illustrated left-hand elbow pad. Because of the arcuate side edge surface 22, the elbow pads 20 include a horn portion 76 which is disposed somewhat in front of and extending a short distance across the front of the user 10, and a comparatively enlarged end portion 78 disposed slightly more to the respective sides of the user. FIG. 4 also shows that the end portion 78 may optionally define a through hole 80 opening downwardly from the bottom of the recess 74. In other words, the recess 74 may have a closed bottom, or may lead to the through hole 80, as is depicted in FIG. 4. This through hole 80 may be more preferred by some users, or may be advantageous in environments where the users desire ventilation for the elbow while resting upon the pads 20.

In the use of the elbow rests 18, the user 10 first selectively positions the elbow rests in horizontally spaced apart positions along the work table 12. That is, the worker uses the first degree of freedom (arrow 38) to select the width of the work space 10' for accepting the worker's torso. Of course, workers who are slight of build may desire to have their elbow rests 18 spaced more closely than a worker who is of larger frame size. Regardless of a worker's size or height, they will be able to find an adjustment of the elbow pads 18 along the table top which fits their preferences and the task at hand to be performed. This initial positional adjustment is retained by tightening the clamp screw 36.

Similarly, the worker 10 may select the position of the elbow rest pad 20 in each of the other degrees of freedom or adjustability (as is indicated by the arrows 50, 52, 58, 66, and 68 (for a total of six degrees of adjustability freedom for the position of the elbow pad 20). This adjustment may be accomplished by manually snugging the clamp handle 60 only sufficiently to allow moderately forceful movements by hand of the various parts of the elbow rest 18 at the clamp structure 42, while setting this clamp handle sufficiently tight that adjustments are retained. When the worker 10 is satisfied with the positional adjustments, they may all be retained by the simple tightening of the single clamp handle 60. This final tightening may be achieved for each of the elbow rests 18 while the workers associated elbow is resting on the pad 20 to confirm the adjustment position, and the other hand is used on the handle 60. That is, the handles 60 are each disposed toward the other of the two elbow rests 18 to make them accessible to the other hand of the worker 10 for simultaneously locking all but one of the six degrees of adjustment of the elbow rest 18 with a single hand.

Once the user 10 has set the elbow rests 18 on the table 12 and completed the positional adjustments as described immediately above, the user will be assisted in maintaining a fatigue-resistant erect posture at the work table 12. Further, the user 10 will find it easier to work with an erect head and with the hands supported and steadied at an easily-viewed elevated position, if desired, before the user's eyes for doing fine-detail tasks. In those circumstances where it is desired to have the user's hands at an elevation near the top 14 of the table 12, adjustments of the positions of the elbow rests 18 to facilitate such a position are easily arrived at with a little trial and error adjustment of the elbow rests 18. The extremely quick and easy adjustment capability of the elbow rests 18 is an advantage both in initial set up of the elbow rests, and also in the change from a set up for one task to a different set up for another task. With use and experience with the elbow rests 18 workers generally become very proficient at selecting adjustments of the rests which will be of assistance in performing various tasks. Experience has shown that particularly for fine-detail tasks to be performed at a table, workers very much appreciate and want the posture assistance, hand steadying, and fatigue reduction offered by the elbow rests of the present invention.

While the present invention has been depicted, described, and is defined by reference to a particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

We claim:

1. An ergonomic elbow support comprising:

a clamp member supportingly engageable with a table top adjacent a forward edge thereof, the clamp member carrying a generally horizontally extending elongate first support member extending forwardly generally perpendicularly to the table top forward edge;

a clamp structure of two parts carried movably on said first support member, a first of said two parts of said clamp structure selectively adjustably engaging said first support member both for pivotal movement about the axis thereof and for sliding longitudinal movement along the length of said first support member toward and away from said forward table top edge, a second of said two parts of said clamp structure being pivotally carried by said first part of said clamp structure for pivotal movement about an axis perpendicular to said first support member;

an elongate second support member carried by said second part of said clamp structure and extending generally vertically, said second support member being selectively adjustably engaged by said second clamp structure part both for relative pivotal movement and for relative longitudinal movement along the axis of said second elongate support member (substantially vertically relative to the table top surface), said clamp structure including selectively adjustable securing means for simultaneously locking all of said pivotal and longitudinal relative movements of said clamp structure parts both relative to one another and relative to said first and second support members;

at an upper end thereof said elongate second support member carrying a generally planar cushioned ergonomic elbow pad member.

2. The ergonomic elbow support of claim 1 further including said ergonomic elbow pad member in plan view including an arcuate side edge surface disposed in confronting juxtaposition with a user's torso.

3. The ergonomic elbow support of claim 2 further including said ergonomic elbow pad defining an elbow-receiving recess.

4. The ergonomic elbow support of claim 3 wherein said elbow-receiving recess is positioned relative to said arcuate side edge surface so as to receive a user's elbow while the user rests the torso upon said side edge surface.

5. The ergonomic elbow support of claim 1 wherein said elbow pad member additionally defines an elbow-receiving through hole.

6. The ergonomic elbow support of claim 1 wherein said first horizontally extending support member is the sole horizontally extending support structural element between said table and said elbow pad.

7. The ergonomic elbow support of claim 1 wherein said clamp member is horizontally movable along said table top to define a first degree of adjustment freedom for said elbow support, said elbow support including in addition five degrees of adjustment freedom of said elbow pad relative to said table, and said elbow support including means for simultaneously locking all five of said additional degrees of adjustment freedom.

8. The ergonomic elbow support of claim 7 wherein said means for simultaneously locking includes said clamp structure having said pair of parts pivotally connected to one another and each providing a corresponding pair of said degrees of adjustment freedom, and a locking member connecting said pair of parts and effective when tightened to lock said pair of parts in a selected pivotal position relative one another and also to lock said corresponding pairs of adjustment freedoms for said pair of parts, and means for tightening said locking member.

9. The ergonomic elbow support of claim 8 wherein said locking member includes an elongate locking bolt having a head portion bearing on one of said pair of parts and a locking handle threadably engaging said locking bolt and bearing on the other of said pair of parts.

10. The ergonomic elbow support of claim 9 wherein a second of said pair of parts carries said generally vertically extending second support member which in turn carries said elbow pad, said first and said second support members being generally cylindrical to provide both pivotal and longitudinal movements relative to corresponding ones of said pair of parts of said clamp structure.

11. An ergonomic elbow support comprising:

an ergonomic elbow pad member having when viewed in plan an enlarged end portion and an extending horn portion, said portions of said elbow pad member cooperating to give generally the appearance of a grand piano with an arcuate side edge surface conformal to a torso of a user of said elbow support, the enlarged end portion being disposed generally below an elbow of said user and said horn portion extending generally across the user's torso toward the center thereof; and structural support means for adjustably positioning and supporting said elbow pad member relative to a table top or other work surface at which the user is to perform a task.

12. The ergonomic elbow support of claim 11 wherein the recited elbow pad member is configured to be "handed"; and an oppositely-handed elbow pad member which is other wise the same as said first-recited elbow pad member and which is disposed to support the other of said user's elbows.

13. The ergonomic elbow support of claim 12 wherein said arcuate side edge surfaces of said elbow pad members cooperatively define a work space for receiving therein the torso of said user.

14. The ergonomic elbow support of claim 11 wherein said elbow pad members each include a cushion for the user's elbows.

15. The ergonomic elbow support of claim 14 wherein said cushion is formed of self-skinning foamed polymeric material.

16. The ergonomic elbow support of claim 14 wherein said cushion defines an elbow-receiving recess disposed on said enlarged end portion.

17. The ergonomic elbow support of claim 14 wherein said cushion defines a through hole for receiving the elbow of said user.

18. The ergonomic elbow support of claim 11 wherein said structural support means includes a C-shaped clamp member engageable with said table top; said clamp member carrying a generally horizontally extending rod projecting forwardly of said table top, a clamp structure carried upon said rod, and a generally vertically extending shaft carried by said clamp structure and carrying at an upper end thereof said elbow pad member.

19. The ergonomic elbow support of claim 18 wherein said clamp structure further includes a locking bolt pivotally connecting a pair of parts of said clamp structure which correspondingly associate pivotally and linearly movably with said rod and said shaft, tightening of said locking bolt being effective to lock pivotal connections of said pair of parts of said clamp structure as well as preventing relative pivotal and linear movement of said rod and said shaft relative thereto.

20. A method of supporting an elbow of a human user, steadying the user's associated hand, and also at the same time assisting the user in maintaining a fatigue-resistant posture for performing a work task at a table, said method including the steps of:

providing at least one ergonomic conformal elbow rest to said user;

providing said at least one ergonomic conformal elbow rest with an elbow support pad having a cushioned upper surface for receiving and supporting an elbow of said user, and an arcuate side edge surface confronting a torso of said user to cooperate in defining a work space at an associated forward edge of said table for receiving the user's upper body;

providing adjustable support structure associated with said table for supporting said elbow support pad while allowing full position adjustability and retention of said elbow support pad in horizontal, vertical, pivotal, and angulation senses;

allowing the user to rest a significant portion of the weight of the user's upper body on said elbow support pad to assist the user in maintaining an erect spinal and head posture; and steadying with said elbow support pad the user's associated hand relative to said table to assist the user in accomplishing the work task.

* * * * *